United States Patent [19]

Dinkelacker

[11] 4,336,074

[45] Jun. 22, 1982

[54] METHOD AND APPARATUS FOR CLEANING DRAINS

[75] Inventor: Albrecht Dinkelacker, Göttingen, Fed. Rep. of Germany

[73] Assignee: Max-Planck-Gesellschaft zur Forderung der Wissenschaft e. V., Gottingen, Fed. Rep. of Germany

[21] Appl. No.: 129,824

[22] Filed: Mar. 12, 1980

[30] Foreign Application Priority Data

Mar. 15, 1979 [DE] Fed. Rep. of Germany ..... 2910281
Mar. 15, 1979 [DE] Fed. Rep. of Germany ..... 2910281

[51] Int. Cl.[3] ..... B08B 9/04

[52] U.S. Cl. ..... 134/8; 15/104.06 R; 15/104.3R; 134/22.12

[58] Field of Search ..... 134/8, 22.12; 15/104.06 R, 104.3 R

[56] References Cited

U.S. PATENT DOCUMENTS

| | | | |
|---|---|---|---|
| 2,258,174 | 10/1941 | Chawner | 15/104.06 R |
| 2,539,354 | 1/1951 | Minyard | 15/104.06 R X |
| 2,668,307 | 2/1954 | Preen | 15/104.3 R X |
| 2,951,255 | 9/1960 | Nooy | 15/104.06 R |

FOREIGN PATENT DOCUMENTS

| | | | |
|---|---|---|---|
| 2543622 | 3/1977 | Fed. Rep. of Germany . | |
| 1214853 | 4/1960 | France | 15/104.06 R |

*Primary Examiner*—Marc L. Caroff
*Attorney, Agent, or Firm*—Cushman, Darby & Cushman

[57] ABSTRACT

The bottom portion of a drain or sewer, partially filled with flowing liquid, is cleaned by placing a cleaning member therein. The cleaning member rolls freely along the bottom portion of the sewer at a lower speed than the flowing liquid. The interior of the cleaning member contains a braking material and throttle structure which tend to reduce the rolling speed of the cleaning member. The cleaning member has an asymmetrical outer surface formed by a plurality of non-intersecting ribs which are asymmetrical with respect to all meridian planes defined by a plurality of rolling meridians along which the cleaning member can roll. This asymmetrical outer surface structure induces a corresponding asymmetric liquid flow around the cleaning member and downstream thereof; thereby laterally deflecting the downstream flow and suspended contaminants out of the rolling path of the cleaning member.

17 Claims, 5 Drawing Figures

METHOD AND APPARATUS FOR CLEANING DRAINS

Figure 1:
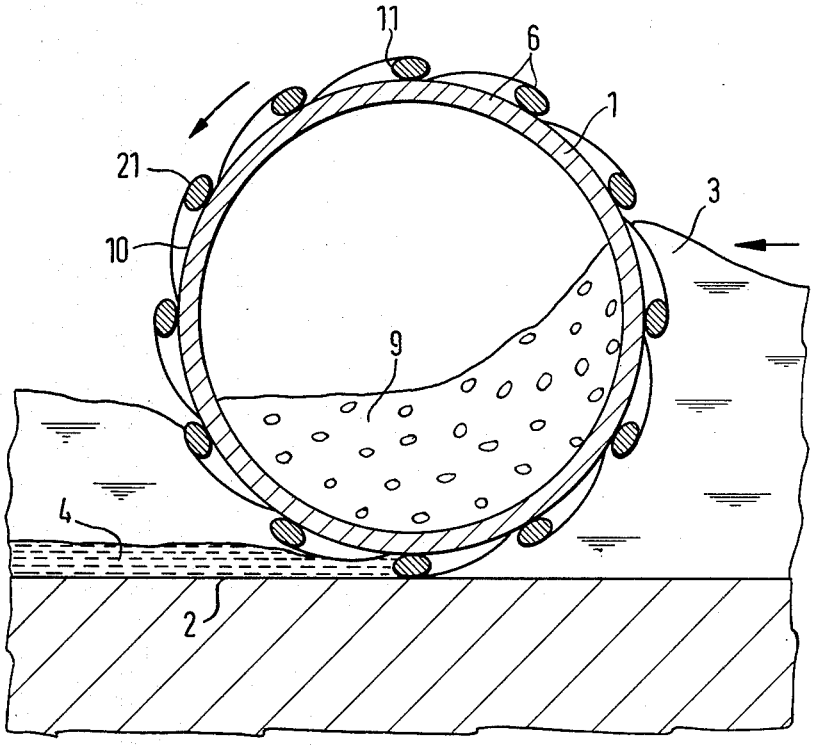

The invention relates to a method and to an apparatus for cleaning large cross-section drains and in particular sewers carrying and only partly filled with a liquid in which a cleaning member in the form of a rolling member resting on the bottom of the drain is rolled on the latter under the action of the flowing liquid and is consequently carried along by the flowing liquid at a lower speed than the average liquid flow rate, thereby producing a flow around the cleaning member which flushes up and washes away contaminants from the bottom of the drain.

As the cleaning member is moved in the drain by the liquid at a lower speed than the flow rate of the latter, it serves to resist the liquid flow, so that the liquid is partly dammed back in front of the cleaning member and the flow is disturbed accompanied by the formation of a deflecting flow which passes by the cleaning member. As a result, the deflecting flow acquires an increased flow rate, so that in front of and alongside the cleaning member deposits are detached from the bottom of the drain, flushed and washed away. Further, as a result of the planned deflection flow within the drain without the blocking thereof there is a flow behind the cleaning member which additionally brings about the detachment and suspension of deposits from the bottom of the drain.

This method and cleaning members suitable for performing this method have been developed by the inventor and are described in German Patent 2,543,622. The disclosure of this patent specification is by reference incorporated into the disclosure of the present application. The cleaning member which, as an independent body which is not suspended on a cable or any other mechanism, is carried along by the liquid flowing in the drain and is constructed in such a way that under the weight conditions by which it is immersed in the liquid and rests on the drain bottom is rolled along the latter in accordance with one or more closed circumferential lines, referred to hereinafter as the "rolling meridian" due to the force transmitted thereto by the flowing liquid. It is preferably constructed as a ball or a ball-like rolling member which can substantially roll in all tangential directions. In order to attain the rolling movement of the cleaning member, the latter can be constructed as a relatively dimensionally stable solid of revolution, but also in the form of a rolling member deformable to a greater or lesser extent under the force with which it rests on the drain bottom immersed in the liquid and which rolls in the manner of a caterpillar or jellyfish.

The slowing down of the speed of the cleaning member compared with the average flow rate in the drain can be achieved in that the cleaning member is made hollow, whereby the cavity thereof contains a braking member which is displaced therein as a result of the rolling movement. Due to the displacement of the braking member, part of the driving energy of the flowing liquid acting on the cleaning member is consumed, so that the resulting movement of the cleaning member along the drain is slowed down compared with the average flow rate of the liquid in the drain (average flow rate is here understood to mean the flowrate calculated from the liquid throughput and the drain cross-section filled with the liquid). The braking member can for example be a ball which, during the rolling of the hollow cleaning member in turn rolls within the latter, or e.g. also a rigid pendulum pivotable about a shaft connected to the cleaning member, whilst overcoming a corresponding friction. However, in the presently preferred solution, the braking member is constituted by a dissipative, flowable liquid and/or component filling which, as a result of the rolling of the cleaning member is constantly arranged in a different layer manner therein. Practical tests have proved a filling of sand and water to be operative. The nature and quantity of the braking material influence within wide limits the movement of the cleaning member.

By means of such a filling of a liquid and/or solid components, the weight of the cleaning member can be adapted to the liquid level over the drain bottom. The dimensions and weight of the cleaning member, whilst adapted to the height of the liquid level over the drain bottom, are selected in such a way that it bears on the drain bottom under its own weight, less its buoyancy, with an adequate friction for its rolling movement under the driving action of the flowing liquid. Advantageously, the cleaning member is made sufficiently large that it is only partly submerged in the flowing liquid. Such a cleaning member can also have such dimensions and such a weight that the specific gravity formed from its total weight and its total volume is approximately identical to or smaller than that of the liquid in the drain, so that in the case of a higher than normal liquid level in the drain (e.g. after heavy rain) the cleaning member floats and can be relatively rapidly transported away by the liquid and thereby preventing an excessive damming back of the liquid at the cleaning member.

Such a drain or sewer cleaning method has the important advantage that with relatively little effort and expenditure existing deposits on the drain bed can be removed or the formation of deposits can be impeded at the outset and as a result can be completely eliminated. This method can also be effectively carried out with a relatively low liquid flow rate in the drain and with a relatively limited gradient of the drain bottom, so that there is no need for corresponding pump stations or damming stages, such as are conventionally required for sewers in areas with limited ground gradients for increasing the flow rate of the sewage and consequently for reducing the formation of deposits.

The known method has proved to be advantageous and effective during practical trials in in part highly contaminated sewers. During these trials, smooth hollow steel balls with a sand and water filling have inter alia been used. However, it has often been observed that, even without large obstacles, the cleaning balls can become stuck on the contaminated sewer bed and can then no longer be moved along by the flowing liquid. Detailed investigations carried out by the inventor has shown that cleaning balls which have briefly stopped for any reason are vigorously circumcirculated by the liquid so that material is flushed away in front of and laterally of the balls, whereby a part of said material is subsequently heaped up in the ball rolling path downstream of the balls under the action of the following flow induced downstream of the balls due to the flow obstacle formed by the same. Such heaping up to material can prevent the further rolling of the balls under the action of the flowing liquid, thereby inducing a self-blocking of the cleaning ball.

The present invention constitutes a further development of the above-defined method and apparatus for cleaning liquid-carrying drains. The present invention also leads to the advantages of the known method and apparatus. However, as a result of the present invention, it is also achieved that the above-mentioned self-blocking of the cleaning member by material heaped up downstream thereof is avoided.

With a method of the type defined hereinbefore the present invention proposes that by the construction of the cleaning member an asymmetrical, lateral circumcirculation thereof and consequently a following flow deflected from the rolling path of the cleaning member downstream of the latter are produced, so that material deposited in the rolling path of the cleaning member downstream thereof and material suspended in the flow which passes the cleaning member downstream thereof is flushed out of the cleaning member rolling path.

The invention is based on the finding that the possible self-blocking of the cleaning member in the contaminated drain is due to the symmetrical circumcirculation of the cleaning member and can therefore be avoided if the cleaning member surface construction is such that the circumcirculation thereof is asymmetrical, preferably in all positions which it can assume within the drain. As a result, the following flow and consequently any dirt deposits are no longer symmetrical, so that contaminants carried along in the circumcirculation of the cleaning member can no longer be increasingly heaped up directly behind the cleaning member which for some reason has briefly stopped or deposits which are present there and which have possibly caused the stoppage of the cleaning member are flushed away in the flow induced by the latter, so that under the action of the flowing liquid the cleaning member can again start moving.

The symmetrical circumcirculation of the cleaning member also means that the pushing force of the liquid no longer acts in a plane of symmetry of the cleaning member, so that under the action of the flowing liquid additional irregular rotary movements are forced onto the cleaning member, so that if necessary it can turn away in front of large deposits of material, thereby detouring the latter. According to the invention, both these processes, i.e. the production of a following flow deflected from the cleaning member rolling path and the inducing of rotary movements on which are superimposed the rolling movement of the cleaning member by an asymmetrical circumcirculation of the cleaning member, can individually or jointly contribute to the prevention of the possible self-blocking of the cleaning member.

For performing the method according to the invention, it is proposed in the case of a cleaning member constructed as a hollow rolling member resting on the drain bed under its own weight and which under the action of the flowing liquid can roll on the drain bed along at least one rolling meridian of its outer surface, it being subdivided into two surface portions by the meridian plane of the cleaning member containing the rolling meridian and in the cavity thereof is placed a braking material displaceable therein whilst slowing down the rolling movement, the two surface portions of the outer surface of the cleaning member are made asymmetrical with reference to the meridian plane at least under the conditions under which the cleaning member rests on the drain bed, so that the two partial flows induced by the cleaning member on either side thereof are correspondingly asymmetrical.

As stated hereinbefore, the term "rolling meridian" is understood to mean a closed outer circumferential line of the cleaning member along which it can be rolled. Correspondingly, "meridian plane" is understood to mean a cross-sectional plane of the cleaning member containing the rolling meridian. In most cases, it is advantageous to construct the cleaning member as a rolling member containing a plurality of such rolling meridians, so that it can roll in many or all directions, as is e.g. the case with a ball.

In this case, the asymmetrical construction of the outer surface of the cleaning member preferably applies to all these possible rolling meridians.

The term "outer surface" of the cleaning member is understood to mean those outer surfaces which during the rolling movement of the cleaning member on the drain bed are immersed in the liquid and consequently contribute to the formation of the asymmetrical circumcirculation flow for the liquid passing by the cleaning member. For example, the outer surface of the cleaning member can be formed from planar and/or curved portions, so that in accordance with the invention an overall asymmetrical outer surface of the cleaning member is formed. Correspondingly constructed projections and depressions distributed over the entire outer surface of the cleaning member can also be provided. However, it must also be noted that the cleaning member has a substantially round outer contour, which ensures the rolling thereof under the action of the flowing liquid.

The asymmetrical pattern of the outer surface of the cleaning member in the sense of the present invention must at the latest be obtained under those conditions where the cleaning member rests on the drain bottom. To this extent, the cleaning member can also be deformable and then only attains its asymmetrical configuration within the meaning of the invention when, under its own weight, less the buoyancy in the liquid and under the action of the flow pressure thereon, it rests on the drain bottom and is thereby deformed.

However, at present, preference is given to a cleaning member the general shape of which is not deformable under the operating conditions. Preference is also at present given to making the cleaning member configuration as close as possible to that of a ball, i.e. making the envelope of the outer contour of the cleaning member a spherical surface.

According to a preferred development of the invention, the outer surface of the cleaning member is formed from interchanging ribs and channels, the asymmetrical pattern thereof within the meaning of the invention being obtained through the ribs and channels on one side of the meridian plane being asymmetrical to the ribs and channels on the other side of the meridian plane.

As a result of the preferred construction of the outer surface of the cleaning member from alternating channels and ribs, the additional advantage of an increased forward thrust of the cleaning member under the action of the flowing liquid is obtained. For this purpose, the ribs act in much the same way as turbine blades and as a result of their asymmetrical pattern the resulting driving force is subject to a continuous directional change. Such an increase in the forward advance of the cleaning member can also make a significant contribution to the prevention of the cleaning member being stuck in the drain.

This increase in the advance force can be further aided by a special configuration of the ribs and in particular through the ribs passing into the bottom of the in each case adjacent channel, said ribs being undercut on one of either side flanks, i.e. forming an acute angle of less than 90° between said side flank and the channel bottom. It is thereby advantageous for the ribs to pass over the outer surface of the cleaning member in arcuate manner and for the undercut to be at least on the inside of the rib arcs.

The channel width is preferably greater than the rib width, so that an optimum good guidance action is obtained for the flows in the channels along the ribs. If as a result of a relatively large spacing of the ribs the rolling movement of the cleaning member becomes too uneven, small projections can be formed between the ribs on the channel bottoms for the purpose of bridging said distance.

Particularly in the case of a cleaning member constructed as a ball it has proved advantageous in practical trials to uniformly distribute the channels and ribs over the outer surface of the cleaning member and preferably for them to be continuous between two pole areas of the outer surface facing the cleaning member, whereby between the pole areas they are given an approximately Z-shaped or S-shaped configuration in such a way that they cross the equator line related to the poles of the poles area in the region of the turning or reversing point between their S-bends. The "S-shaped" and "Z-shaped", respectively, is also intended to cover the reflected image of an S and Z, respectively. Depending on whether the configuration of the ribs and channels approximates that of the letter S or its reflected image, an additional rotary movement in the clockwise or counterclockwise direction is superimposed on the rolling movement of the flowed against cleaning member in a given position of the latter. This can serve to increase the effectiveness of drain or sewer cleaning through, for example, successively arranging two cleaning members in the channel, whose rib and channel configuration is homologous. Thus, the two cleaning members are given differing paths along the drain bottom, so that they have a more uniform cleaning action over the drain width. This procedure can be further improved through a corresponding number of cleaning members with different shapes being passed through the drain. Another possible shape of the ribs is that of a question-mark.

The asymmetrical configuration of the outer surface of the cleaning member can also be achieved by corresponding bevels on the outer surface and/or the formation of depressions therein, whereby it can be advantageous for obtaining an optimum smooth rolling movement of the cleaning member to form an overroll member over such bevels or depressions. Such an overroll member over a depression can also be appropriate for forming a handle, which serves as a grip or a suspension stirrup for a crane hook, so that the cleaning member can be lowered by means of a crane through a shaft into the underground sewer. p Asymmetrical cleaning members according to the invention have proved very satisfactory in practical trials. The above-described self-blocking effect is no longer observed. The braking filling used for these trials was a mixture of sand and water.

However, in the case of a braking filling of sand and water when the cleaning member has been stationary for a long time the sand has settled and become consolidated therein thereby loosing its capacity to change layers for decelerating the rolling speed of the cleaning member. When this happens, there is a risk that the cleaning member will not automatically start moving until the action of the flowing liquid, because the consolidated sand leads to the formation of a stable centre of gravity position for the cleaning member and the driving force of the flowing liquid is no longer sufficient to overcome this. This danger exists more particularly when there is a high percentage of sand, the latter being otherwise desirable for bringing about a minimum rolling speed for obtaining a maximum circulation around the cleaning member. A prolonged stoppage of the cleaning member has also for example occur in the case of the above-defined asymmetrical configuration of the latter when in a contaminated drain it is initially stopped by a dirt or sludge accumulation and the latter is only gradually flushed away by the following flow behind the cleaning member.

Accordingly, in a further development of the invention, it is prefered to exclusively use a braking liquid for the braking filling adapted to cooperate with a throttle structure with a plurality of throttle openings which throttle structure is fixed to the cavity of the cleaning member and is distributed over at least the circumferential surface thereof and serves to slow down the layer change of the braking liquid during the rolling movement of the cleaning member.

During the rolling movement of the cleaning member the braking liquid which only partly fills it attempts to continuously change layers in such a way that its liquid level always remains horizontal. The liquid flows necessary for this are, however, settled in the throttle structure, so that part of the braking liquid is raised by the throttle structure on one side of the median plane of the cleaning member which is at right angles to the rolling path, whilst part of the braking liquid on the other side of said median plane is lowered. Thus, the centre of gravity of the braking liquid filling is displaced from the said median plane, so that a brake torque is formed acting counter to the rolling movement and which correspondingly slows down the rolling speed of the cleaning member. Thus, as a function of the nature and quantity of the braking liquid used, a low and uniform rolling speed can be achieved. As the layer changer of the braking liquid in the throttle structure is slowed down, but is not prevented due to the throttle openings, the above-mentioned brake torque disappears during prolonged stoppage of the cleaning member, because as a result the liquid can collect symmetrically in the lowest part of the cleaning member and consequently the action line of the resulting force of gravity of the cleaning member passes through its support point on the drain bed. As a result of this and due to the liquid consistency of the braking filling the recommencement of rolling of the cleaning member under the action of the flowing liquid is assisted following any stoppage. The brake torque is only formed again just after the start of rolling.

Thus, it is possible by corresponding dimensioning of the flow cross-sections of the throttle openings as a function of the viscosity of the braking liquid and as a result of the quantity of braking liquid in the cavity of the cleaning member to reduce the deceleration speed of the latter to very small uniform values, so that the speed difference between the cleaning member moving along the drain bed and the flowing liquid is high and consequently there is a vigorous circumcirculation of the cleaning member. Although it is possible to use the braking means according to the invention for cleaning bodies with a symmetrical surface, for example in the form of a smooth ball surface, so that the circumcirculation on both sides caused by the cleaning member is symmetrical, the invention is preferably used in conjunction with the above-described cleaning member with an asymmetrical surface.

Preferably, the throttle structure forms a plurality of chambers distributed over the circumferential surface of the cavity which are interconnected in their common walls by said throttle openings, so that during the rolling movement of the cleaning member an overflow of braking liquid from one chamber into another is throttled by the throttle openings.

The throttle openings are to be distributed and constructed in such a way that the braking liquid level in all the chambers after a more or less long period since the stoppage of the cleaning member arrives at substantially the same in all the possible layers. Preferably, the throttle openings are at least largely arranged in the immediate vicinity of the inner surface of the cleaning member bounding the cavity. According to a preferred solution, this can be attained in simple manner in that the chambers are formed by disks passing diametrically between the cleaning member cavity and at least part of the throttle openings is in the form of gaps between the outer edge of the disks and the inner surface of the cleaning member.

The structures in the cleaning member cavity necessary according to the invention for forming the chambers are preferably constructed in such a way that their overall centre of gravity coincides with the centre of the cleaning member. Thus, these structures are preferably constructed in spatial rotational symmetry to the centre of the cleaning member.

The throttle structure can also be formed from a porous material filling which, e.g. comprises a material packing of balls, chips, expanded metal, wire balls, etc filled into and compressed within the cavity, so that between the material fragments larger or smaller through-flow openings or ducts are formed, as a function of the packing density, and serve to form the throttle openings. By modifying the packing density, it is possible to regulate the flow resistance to the free layer changing of the braking liquid and consequently the braking action for decelerating the rolling speed. The material filling can also be e.g. a sintered cake or an open-bore hard foam material, whose pore cavities are permeably interconnected for the braking liquid. Such a porous material filling can also be provided in addition to the above-described chambers.

The invention is further explained in exemplified manner hereinafter relative to a cleaning member in the form of a ball shown in the drawings, wherein represent:

FIG. 1 the cleaning member in section when rolling on a sewer bed.

Figure 2:
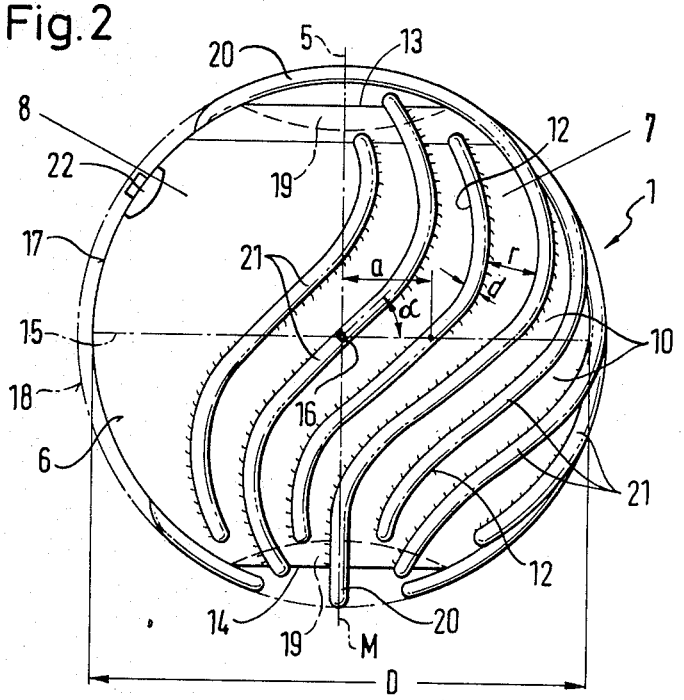

FIG. 2 an external view of the cleaning member of FIG. 1.

Figure 3:
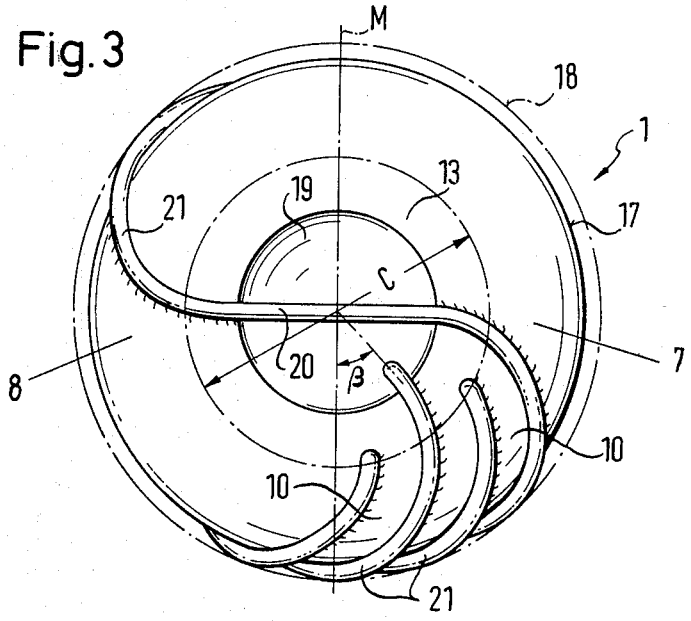

FIG. 3 the plan view of the cleaning member of FIG. 2.

Figure 4:
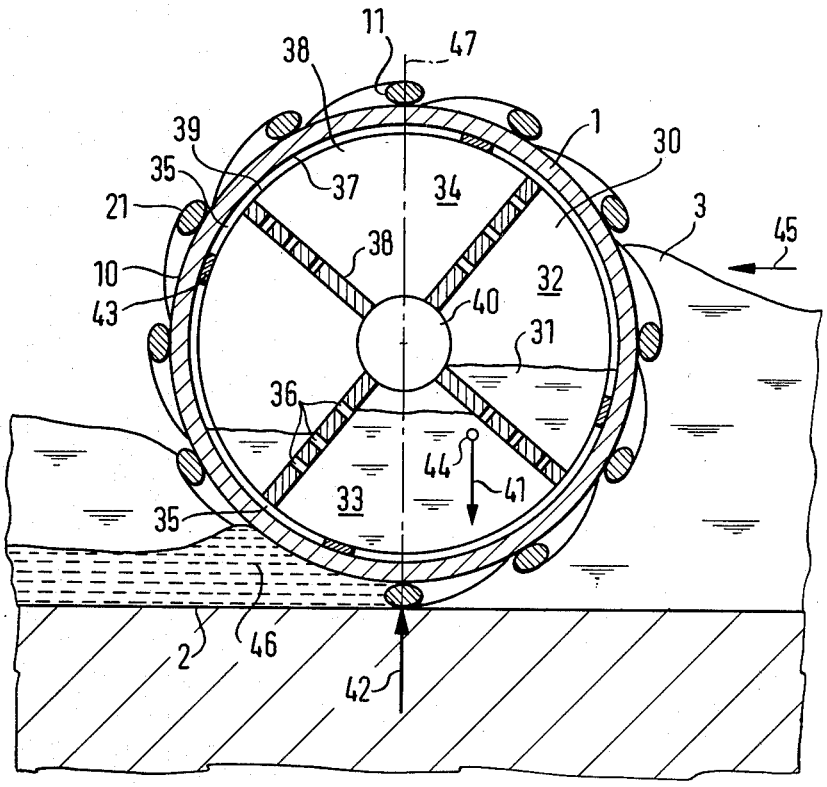
Figure 5:
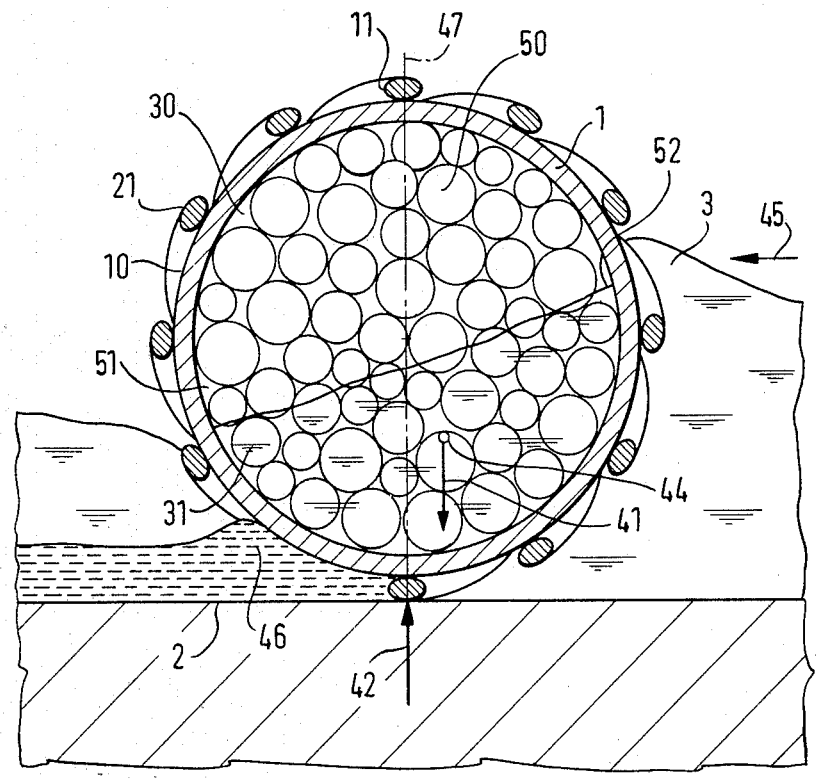

FIGS. 4 and 5 two other embodyments in cross-sectional view.

As can be gathered from FIG. 1, in operation the cleaning member 1 in the form of a ball is only partly immersed in the liquid 3 flowing in the drain and rests on the drain bottom 2 due to its own weight, less the buoyancy as a result of the liquid displaced by it. The cleaning member 1 is hollow. Its cavity is partly filled with a braking material 9 displaceable therein, which for example is constituted by a mixture of sand and water. Thus, the cleaning member is rolled on the drain bottom 2 under the action of liquid 3 flowing in the direction of the arrow. Its rolling movement is slowed down compared with the average flow rate of the liquid in the drain by the permanent change in the layer formation of the braking material 9, so that the cleaning member forms a flow resistance and thereby ensures that the deflecting flow passing it on either side is given a higher speed than the average liquid flow rate in the drain. The cleaning member 1 is thereby vigorously circumcirculated so that the deposits present as a more or less thick dirt layer 4 on the drain bottom 2 in front of and alongside the cleaning member and in the following flow induced by it downstream of the cleaning member are flushed up and washed away.

The cleaning member 1 in FIG. 1 is formed from a smooth hollow ball with ribs 21 distributed over the outer surface thereof. The ribs are for example in the form of welded-on pipes whose ends are sealed in water-tight manner, so that between the ribs 21 channels 10 are formed, whose width can exceed by a multiple the width of the ribs 21. The channels 10 and ribs 21 extend over the entire outer surface of the cleaning member 1 in such a way that the flow formed thereon which passes the cleaning member in such a way that on one side thereof it has a different course thereof in substantially all the layers of the cleaning member 1 to that on the other side thereof. As a result of the asymmetrical circumcirculation of the cleaning member, the following flow induced downstream thereof is deflected from the actual path of the cleaning member. This prevents any heaping up immediately behind the cleaning member of contaminants passing by the latter in the deflection flow, so that its rolling on the drain bottom 2 is not blocked by such accumulations. Due to the circumcirculation of the cleaning member which is asymmetrical to the vertical median plane of the cleaning member 1, which is parallel to the actual rolling path thereof and contains its centre of gravity, the resulting driving force of the liquid does not generally act in said median plane, so that the cleaning member is subject to a torque as a result of which a rotary movement about a vertical axis is superimposed on the rolling movement of the cleaning member. Therefore, the rolling movement of the cleaning member is no longer linear and instead carries out generally irregular lateral movements, which also contribute to preventing a self-blocking of the cleaning member due to contaminants deposited behind it as a result of the action thereof.

The ribs 21 also considerably increase the forward thrust of the cleaning member 1 under the action of the flowing liquid 3, so that it can overcome or escape larger deposits of dirt or sludge. The increase in the forward thrust can be aided by the fact that the lateral flanks 11 of the ribs 21 enter the base surface of the adjacent channel 10 with an undercut, so that an increased dynamic pressure is formed in the angle between the lateral flanks 11 of ribs 21 and the base surface of the channels 10 and as a result the thrust is correspondingly increased.

An example of a distribution pattern for the ribs and channels on the outer surface of the cleaning member 1, which has proved advantageous in practical tests, is shown in FIGS. 2 and 3. The ribs and channels are distributed over the entire outer surface of the cleaning member, although only a small number thereof are shown. The ribs 21 run between two pole areas 13, 14 diametrically facing the spherical cleaning member 1 with a substantially S-shaped configuration, so that their reversal points 16 between their S-bends are located on a common circular line which represents the equator line 15 with respect to the poles of pole areas 13, 14. The angle $\alpha$ formed by the ribs 21 with the equator line 15 at the reversal point 16 has in advantageous manner been given a value of 45°. The spacing a of ribs 21, measured along the equator line 15 was 1/12 to 1/16 of the ball circumference. The rib width b was much smaller than the rib width r.

The ribs 21 ended at pole areas 13, 14 in such a way that the angle $\beta$ between the extension of their ends and the meridian plane M extending between the ball centre and the poles of pole areas 13, 14 at right angles to the equatorial plane containing equator line 15, had a value in the range 45° to 60°. In the pole areas 13, 14, whose diameter C was approximately 0.3D, every other rib 21 terminated at a smaller spacing from the pole of the pole area than the other ribs, so that at pole areas 13, 14 the channels 10 were open at the end face. As a result of this configuration, a relatively smooth flow can form under the guiding action of ribs 21 and channels 10. For the present trial, the cleaning member had a diameter D of 500 mm.

Ribs 21 and consequently channels 10 are distributed in a uniform pattern over the spherical surface 17. The apices of ribs 21 were located on a common spherical surface 18 running concentrically to the spherical surface 17. In the two pole areas 13, 14 a depression 19 is formed in each case and is traversed by one of the ribs 21 in the form of an overroll member 20, so that the cleaning member can roll over depression 19. To this end, certain of the ribs 21 can project beyond the edge of depression 19, as shown in FIGS. 2 and 3. In the present embodiment, depression 19 and overroll member 20 serve as a grip for raising and lowering the cleaning member on a crane or as a handle.

In order that the amount of brake filling material can be increased or decreased in accordance with the actual liquid level in the drain and the flow conditions, preferably two different filling connections 22 are provided and are arranged in diametrically opposite manner between two ribs 21 and do not project beyond the outer spherical surface 18, so that it is possible to roll over them without forming an obstacle.

Assuming in the case of FIG. 2 that the bottom of the cleaning member rests on the drain bed and the liquid in the drain flows at right angles to the drawing plane, it rolls along the rolling meridian 5 of the outer spherical surface 18, whilst the meridian plane M containing the rolling meridian 5 is directed vertically. Meridian plane M subdivides the outer surface 6 of the cleaning member into two surface portions 7 and 8. It is readily apparent from FIG. 2 that the course of ribs 21 and channels 10 on one of the surface portions 7 is asymmetrical with respect to the meridian plane M to the course of the ribs and channel s on the other surface portion 8. Thus, under the guiding action of ribs 21 and channels 10, a flow is produced on one surface portion 7 which is asymmetrical to the flow produced on the other surface portion 8.

FIGS. 2 and 3 also show that this asymmetrical configuration of the ribs and channels applies to substantially all the possible rolling meridians along which the cleaning balls roll in the present case.

The ribs 21 formed from tubes whose ends are welded are welded to the bottoms of the balls forming the channels 20 and which are in the form of steel balls by continuous welding seams or points. In order to bring about the undercutting for increasing the advance thrust as explained in conjunction with FIG. 1 the welding seams only appear on the outsides of the S-bends of the ribs 21, so that the latter essentially only form the undercuts on the insides 12 of the bends. The cleaning members of FIGS. 4 and 5 each differ from that of FIG. 1 by the braking means in its cavity.

In the embodiment of FIG. 4, the cavity 30 of cleaning member 1 contains three disks 38 which cross one another at right angles and pass diametrically through said cavity, so that they subdivide the latter into eight chambers 32, 33, 34, which are radially symmetrical to the centre point of the ball. The circular disks 38 have a somewhat smaller diameter than the inner surface 37 of cleaning member 1, so that there is a gap 35 between the outer edge 39 and the inner surface 37. In this position, the disks 38 are held by means of spacing blocks 43 on the inner surface 37 of the cleaning balls.

Cavity 30 of cleaning member 1 is also partly filled with a braking liquid 31, which can for example comprise water or more or less viscous oil or a liquid mixture. As a function of the viscosity of the braking liquid, the gaps 35 used for interconnecting the individual chambers 32, 33 and 34 ae dimensioned in such a way that they act as a throttle opening in which the flow of the braking liquid flowing from one chamber into the adjacent chamber is decelerated in the manner of a calibrated orifice. In addition or as an alternative throttle openings can be provided in the disks 38, as shown in exemplified manner by holes 36. It is also possible to make the disks 38 from a material which is sufficiently porous for forming the throttle openings, e.g. a sintered material.

Thus, when the cleaning member 1 rolls on the drain bottom 2 under the action of the liquid flowing in the drain, in the present embodiment in the direction of arrow 45, in those chambers which during the rolling movement have rotated from their lowest position in cavity 30 of cleaning member 1 into a higher position the braking liquid 31 is raised to above the normal liquid level, as shown for chamber 32 in the drawings. As a result, the instantaneous centre of gravity 44 of all the braking liquid 31 is displaced from the vertical median plane 47 passing through the centre of the cleaning ball and its support point on the drain bottom 2, so that a torque is produced by the gravity components 41 acting in the instantaneous centre of gravity 44 with the bearing force 42 acting on the cleaning ball at the support point thereof of the drain bottom 2 and said torque acts counter to the rolling movement of the cleaning ball, so that the latter is decelerated to a correspondingly lower rolling speed.

However, if the cleaning member is stopped by a material accumulation 46 on the drain bottom 2, part of the braking liquid 31 flows out of chamber 32 through throttle openings 35, 36 and gradually passes into the lower-lying adjacent chamber 33 until the liquid level is the same in both chambers. The instantaneous centre of gravity 44 is therefore displaced into the vertical median plane 47 of the cleaning member, so that the brake torque acting against the rolling movement of cleaning member disappears and under the action of the flowing liquid the cleaning member 1 can more easily start moving again as soon as the dirt deposit 46 has been partly or completely washed away. As soon as cleaning member 1 starts moving again the brake torque which opposes the rolling movement builds up again. As a result of the invention, this brake torque can be relatively large in order to obtain a very slow rolling movement for bringing about a maximum circumcirculation of the cleaning member, without there being any such risk of the latter being stuck on the drain bottom 2 following a stoppage.

In the represented embodiment, chambers 32, 33 and 34 are connected by a relatively large central opening 40 in disks 38, in addition to the throttle openings 35, 36. This limits the maximum stroke of the braking liquid during the rolling movement of the cleaning member, so that there is a corresponding upward limitation of the maximum brake torque.

The ribs 21 can be made from a rigid material, e.g. a welded on, terminally water-tight sealed pipe. However, it has been found that there is a relatively large amount of wear with such rigid ribs 21, so that they are preferably made from elastically resilient material.

In the embodiment of FIG. 5, the complete cavity is filled with a material 50 in the form of a dense packing of plastic balls, between which the throttle openings 51 are formed. The balls can be made from an elastically resilient material, so that they can be repressed by introducing additional balls and consequently the cross-sections of the throttle openings 50 becomes smaller and the throttling action can be regulated. The remaining space in cavity 30 is partly filled with a braking liquid 31. As the material filling cannot move within the cleaning member 1 during the rolling movement thereof part of the braking liquid is raised on the leading side of the vertical median plane 47 of the cleaning member and part of the braking liquid is lowered on the trailing side of the median plane 47, so that a sloping liquid level 52 is obtained. Thus, much as in the embodiment of FIG. 4, the instantaneous centre of gravity 44 of the braking liquid is displaced from the median plane 47, so that a brake torque opposing the rolling movement is produced between the gravity component 41 of the braking liquid and the bearing force 42.

The cleaning effect of the cleaning member can be improved if the rolling path of the cleaning member is not straight and, accordingly, a wider sector of the bottom of the drain is covered. Such not straight rolling path can be induced by an irregular distribution of the throttle openings over the throttle structure, i.e. by irregularly different size of the throttle openings and/or different numbers of throttle openings per unit of area. Thus, the direction of the braking force excerted by the braking liquid changes during the rolling movement of the cleaning member, thereby superimposing lateral rolling movements to the forward movement of the cleaning member.

I claim:

1. Method for cleaning the bottom portion of large cross-section drains, which are only partly filled with a liquid flowing along the drain bed, from contaminants deposited on the drain bed, comprising rolling a cleaning member freely along the drain bed under the action of the flowing liquid, braking the rolling movement so that the cleaning member moves at a lower travel speed than the average liquid flow rate of the flowing liquid in the drain so that the cleaning member lies by its weight and volume on the drain bed so as to be spaced from the sides of the drain, inducing a circumcirculating flow of the flowing liquid about the cleaning member and simultaneously developing an increased flow rate, said cleaning member having an outer surface formed so as to define a plurality of rolling meridians which define a plurality of rolling paths along which the cleaning member can roll and a like plurality of meridian planes, said circumcirculating flow being comprised of two lateral partial flows at either side of the cleaning member resulting in a downstream flow to flush deposited contaminants to the downstream side of the cleaning member, wherein the cleaning member has an asymmetrical surface formed from a plurality of non-intersecting elements which are asymmetrical with respect to all meridian planes and which cooperate together to induce the circumcirculating flow to be in the form of two partial circumcirculation flows which are asymmetrical with respect to the rolling paths of the cleaning member thereby laterally deflecting the downstream flow out of the rolling path of the cleaning member to flush contaminants suspended in the circumcirculation flow out of that rolling path.

2. A method for cleaning the drain bed of a large diameter conduit only partially filled with liquid flowing along the drain bed comprising the steps of inserting a cleaning member into the conduit, the cleaning member having an outer surface formed so as to define a plurality of rolling meridians and a like plurality of meridian planes along which the cleaning member can roll and a specific gravity that will allow it to be rolled along the drain bed by the force of the liquid flowing therealong while resting on the bottom of the conduit, creating two asymmetrical circumcirculating flow paths about the cleaning member through a plurality of non-intersecting surface elements which are asymmetrical with respect to all meridian planes with the flow induced on either side being asymmetrical, and an asymmetrical following flow for removing material from the path of travel of the cleaning member through the conduit, braking the rolling of the cleaning member and throttling the braking effect to control movement of the cleaning member to thereby maintain a high rate of liquid circumcirculation asymmetrically about the cleaning member under all rolling conditions.

3. A method as in claim 2 wherein the cleaning member is hollow and the step of braking movement of the cleaning member includes the step of moving or braking liquid between a plurality of chambers defined between wall members provided within the hollow cleaning member and the step of throttling includes the step of flowing the braking liquid through openings provided in the wall members.

4. A method as in claim 2 wherein the step of throttling includes the additional step of creating lateral rolling forces to vary the rolling direction of the cleaning member.

5. Apparatus for cleaning contaminants from the drain bed of large cross-section drains having a drain bed, top and side walls, which are only partly filled with a liquid flowing along the drain bed, comprising a hollow cleaning member having a specific gravity permitting it to rest on the drain bed without engaging the side walls of the drains when immersed in liquid flowing through the drain and be freely rolled under the action of that flowing liquid along a rolling path generally following the flowing direction of the flowing liquid, the outer surface of said cleaning member having a plurality of rolling meridians along which said cleaning member can roll, said rolling meridians defining a like plurality of meridian planes containing said rolling meridians, said cleaning member having braking material provided within its hollow interior and displacable therein to slow down the rolling movement and assure that said cleaning member is carried along at a lower speed than the average liquid flow rate in the drain, said cleaning member having a plurality of non-intersecting surface means located about its exterior surface for inducing a circumcirculation flow of the flowing liquid thereabout said flow being comprised of two lateral partial flows at either side of said cleaning member resulting in a downstream flow wherein each of said surface means extends asymmetrically with respect to each of said meridian planes at least under the conditions under which said cleaning member lies on the drain bed, so that the circumcirculation flow induced by said surface means is asymmetrical with respect to each of the said plurality of meridian planes and the downstream partial flow is laterally deflected out of the rolling path of said cleaning member.

6. Apparatus as in claim 5 wherein said cleaning member is subdivided into two surface portions by a meridian plane and wherein said surface means includes a plurality of spaced apart ribs extending over the exterior surface of said cleaning member, said ribs defining channels therebetween which extend about the cleaning member in a predetermined manner so that the channels on one of said two surface portions are asymmetrical with respect to the meridian plane and the channels on the other of said two surface portions.

7. Apparatus according to claim 6, characterised in that ribs and channels have an at least approximately S-shaped continuous configuration between two pole areas diametrically facing the cleaning member with said ribs terminating prior to the pole areas so that the channels are open ended at the pole areas, wherein said cleaning member has an equator line with said S-shaped ribs crossing said equator line at an angle of approximately 45° and thereafter reverse their S bends.

8. Apparatus according to claim 6, characterised in that the ribs (21) are made of a resilient material.

9. Apparatus according to claim 5, characterised in that the braking material at least partly comprises a porous material.

10. Apparatus as in claim 6 wherein said ribs have side flanks and at least one of the side flanks of said ribs are undercut adjacent the channel defined by that rib.

11. Apparatus according to claim 10, wherein said ribs pass in arcs over the outer surface of said cleaning member with said undercuts being formed on the inside of the said arcs.

12. Apparatus according to claim 6, wherein the width of said channels is greater than the width of said ribs.

13. A cleaning member for cleaning contaminants deposited on the drain bed of large cross-section drains which are only partly filled with a liquid flowing along the drain bed comprising a hollow cleaning member adapted to lie on the drain bed when immersed and to be rolled under the action of the flowing liquid along a rolling path generally following the flowing direction of the flowing liquid, said cleaning member having a braking material in its hollow interior said braking material being displacable therein due to the rolling movement of said cleaning member to slow down the rolling movement so that said cleaning member is carried along by the flowing liquid with a lower speed than the average liquid flow rate in the drain, said cleaning member being further shaped to be laterally passed by the flowing liquid during its travel along the drain bed to induce thereby in the flowing liquid a circumcirculation flow comprised of two lateral partial flows at either side of the cleaning member resulting in a downstream partial flow wherein said braking material in the hollow interior of the cleaning member is a braking liquid only partly filling said hollow interior, said cleaning member further including a throttle structure for said braking liquid fixed in the hollow interior, said throttle structure comprising a plurality of wall members located within said hollow cleaning member, and a plurality of throttle openings distributed within said plurality of wall members, said throttle structure slowing down the displacement of the braking liquid due to the rolling movement of said cleaning member thereby slowing down the rolling movement of said cleaning member.

14. Apparatus as in claim 13 wherein said throttle structure defines a plurality of chambers within said cleaning member, said chambers being interconnected by said throttle openings so that during rolling movement of said cleaning member, braking liquid will overflow from one chamber into another through said throttle openings so that the flow is thereby throttled to a predetermined extent.

15. Apparatus according to claim 14, characterised in that the throttle openings (35, 36) are at least mainly arranged in the vicinity of the inner surface (37) of cleaning member (1) bounding the hollow area therein (30).

16. Apparatus according to claim 14, characterised in that the members (32, 33, 34) are formed between disks (38) passing diametrically through the hollow portion of the cleaning member (1) and at least part of the throttle openings are constructed in the form of gaps (35) between the outer edge (39) of the disks (38) and the inner surface (37) of cleaning member (1).

17. Apparatus according to claim 13, characterised in that the throttle openings (36) are irregularly distributed over said throttle structure.

* * * * *

UNITED STATES PATENT AND TRADEMARK OFFICE

CERTIFICATE OF CORRECTION

PATENT NO. : 4,336,074

DATED : June 22, 1982

INVENTOR(S) : Dinkelacker

It is certified that error appears in the above-identified patent and that said Letters Patent are hereby corrected as shown below:

On the title page

Foreign Application Priority Data should read as follows:

Mar. 15, 1979 [DE] Fed. Rep. of Germany ..... 2910281
Oct. 4, 1979 [DE] Fed. Rep. of Germany ..... 2940304

Signed and Sealed this

*Thirty-first* Day of *August 1982*

[SEAL]

*Attest:*

GERALD J. MOSSINGHOFF

*Attesting Officer* *Commissioner of Patents and Trademarks*